US005657546A

United States Patent [19]

Canaday

[11] Patent Number: 5,657,546

[45] Date of Patent: Aug. 19, 1997

[54] SPOTTING ROUND BORE ALIGNMENT MECHANISM FOR ROCKET LAUNCHER

[75] Inventor: Michael M. Canaday, King George, Va.

[73] Assignee: The United States of America as represented by the Secretary of the Navy, Washington, D.C.

[21] Appl. No.: 514,573

[22] Filed: Aug. 14, 1995

[51] Int. Cl.[6] ..... F41G 1/32

[52] U.S. Cl. ..... 33/235; 42/100; 33/241

[58] Field of Search ..... 33/227, 233, 234, 33/235, 237, 241, 247, 248, 257, 258, 286; 42/100, 103; 89/1.819, 41.17, 41.19

[56] References Cited

U.S. PATENT DOCUMENTS

| | | | |
|---|---|---|---|
| 1,613,807 | 1/1927 | Rutherford et al. | 33/248 |
| 2,645,855 | 7/1953 | Ivy | 33/248 |
| 2,814,118 | 11/1957 | Evans et al. | 33/235 |
| 2,876,679 | 3/1959 | Dietsch et al. | 89/41 |
| 3,098,410 | 7/1963 | Giza | 89/1.7 |
| 3,228,299 | 1/1966 | Grandy | 89/41 |
| 3,353,291 | 11/1967 | Musser | 42/1 |
| 3,550,300 | 12/1970 | Roder | 42/1 |
| 4,195,432 | 4/1980 | Hickman | 42/1 R |
| 4,481,861 | 11/1984 | Rodriguez et al. | 89/41 A |
| 4,773,164 | 9/1988 | Taylor et al. | 33/520 R |
| 4,879,814 | 11/1989 | Wallace et al. | 33/324 |
| 4,939,863 | 7/1990 | Alexander et al. | 33/257 |
| 4,941,277 | 7/1990 | Lawlor | 42/100 |
| 5,150,527 | 9/1992 | Knoster | 33/234 |
| 5,365,669 | 11/1994 | Rustick et al. | 33/234 |
| 5,454,168 | 10/1995 | Langner | 33/241 |
| 5,531,040 | 7/1996 | Moore | 42/103 |

*Primary Examiner*—G. Bradley Bennett

*Attorney, Agent, or Firm*—James B. Bechtel, Esq.

[57] ABSTRACT

A mechanism for providing fine adjustment to achieve parallelism of a spotting rifle barrel and a launcher tube is provided. The mechanism uses a convex spherical or near spherical surface on the rear of the spotter barrel which is mated to a concave conical surface on the spotting rifle receiver. The receiver is rigidly affixed to the launcher tube. The spotting rifle barrel axis is adjusted by means of three adjustment screws which act on a locating washer attached to the muzzle of the rifle. The locating washer has a spherical or near spherical surface whose radius center is co-located with the radius center of a second spherical surface supporting the breech end of the barrel. These spherical surfaces permit the free pivoting of the barrel about the common radius centers. A barrel gripping collar is moved into contact with the locating washer by means of a spring which forces the convex conical surface of the locating washer to engage the concave conical surface of the grip collar. This engagement creates a wedging action which causes the grip collar, which is split, to tighten onto the muzzle of the spotting barrel. The action of a spring causes the grip collar to be forced into the locating washer and also forces the barrel into the receiver. This spring also allows for barrel expansion, caused by heat during firing, without affecting the alignment of the axis.

12 Claims, 3 Drawing Sheets

SPOTTING ROUND BORE ALIGNMENT MECHANISM FOR ROCKET LAUNCHER

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to gun aiming devices and in particular to adjustable barrel alignment mechanisms for spotter rifles.

BACKGROUND OF THE INVENTION

Spotting rifles have been used for larger bore guns and rocket devices for several years. The advent of the ballistically matched spotting round has greatly reduced the difficulty and time required to align the spotting charge impact with the main tube round. However, even with ballistically matched spotting rounds in order to have the spotter trajectory approach as closely as possible the larger weapon, it is necessary to have a very accurate alignment of the spotter rifle barrel with the main tube. Typically this alignment requires multiple adjustments to the spotter weapon where it attaches to the rocket launcher tube. A preferred solution is to adjust the barrel of the spotting rifle without having to relocate the entire spotting rifle in relation to the main tube or main rifle. A problem has developed however in previous attempts to move the barrel while maintaining a fixed receiver in that gaps or misalignments occurred while moving the barrel at the receiver end. Also, during firing of the weapon, the increased heat and the expansion of the barrel can cause a misalignment. A simple geometry is needed that will allow a single point adjustment of the barrel and which will also maintain a sealed mating surface between barrel and receiver of the spotting rifle. Also, it is desired to accommodate heat-induced expansion of the spotter rifle barrel without causing any misalignment.

SUMMARY OF THE INVENTION

Accordingly, it is an object of the invention to provide an alignment mechanism having a fine adjustment for a spotter rifle barrel.

It is also an object of the invention to provide an alignment mechanism having a means of compensation for heat-induced expansion while maintaining barrel alignment.

A further object of the invention is to provide an alignment mechanism having a surface which permits free pivoting of the spotter rifle barrel around a specific radius center.

Yet another object of the invention is to an alignment mechanism having a centering means for the muzzle of the spotting barrel.

The invention is a mechanism for providing fine adjustment to achieve parallelism of a spotting rifle barrel and a launcher tube. The preferred embodiment uses a convex spherical or near spherical surface on the rear of the spotter barrel which is mated to a concave conical surface on the spotting rifle receiver. The receiver is rigidly affixed to the launcher tube. The spotting rifle barrel axis is adjusted by means of three adjustment screws which act on a locating washer attached to the muzzle of the rifle. The locating washer has a spherical or near spherical surface whose radius center is co-located with the radius center of a second spherical surface supporting the breech end of the barrel. These spherical surfaces permit the free pivoting of the barrel about the common radius centers. A barrel grip collar is moved into contact with the locating washer by means of a spring which forces the convex conical surface of the locating washer to engage the concave conical surface of the grip collar. This engagement creates a wedging action which causes the grip collar, which is split, to tighten onto the muzzle of the spotting barrel. The action of a spring causes the grip collar to be forced into the locating washer and also forces the barrel into the receiver. This spring also allows for barrel expansion (caused by heat during firing) without affecting the alignment of the barrel axis.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
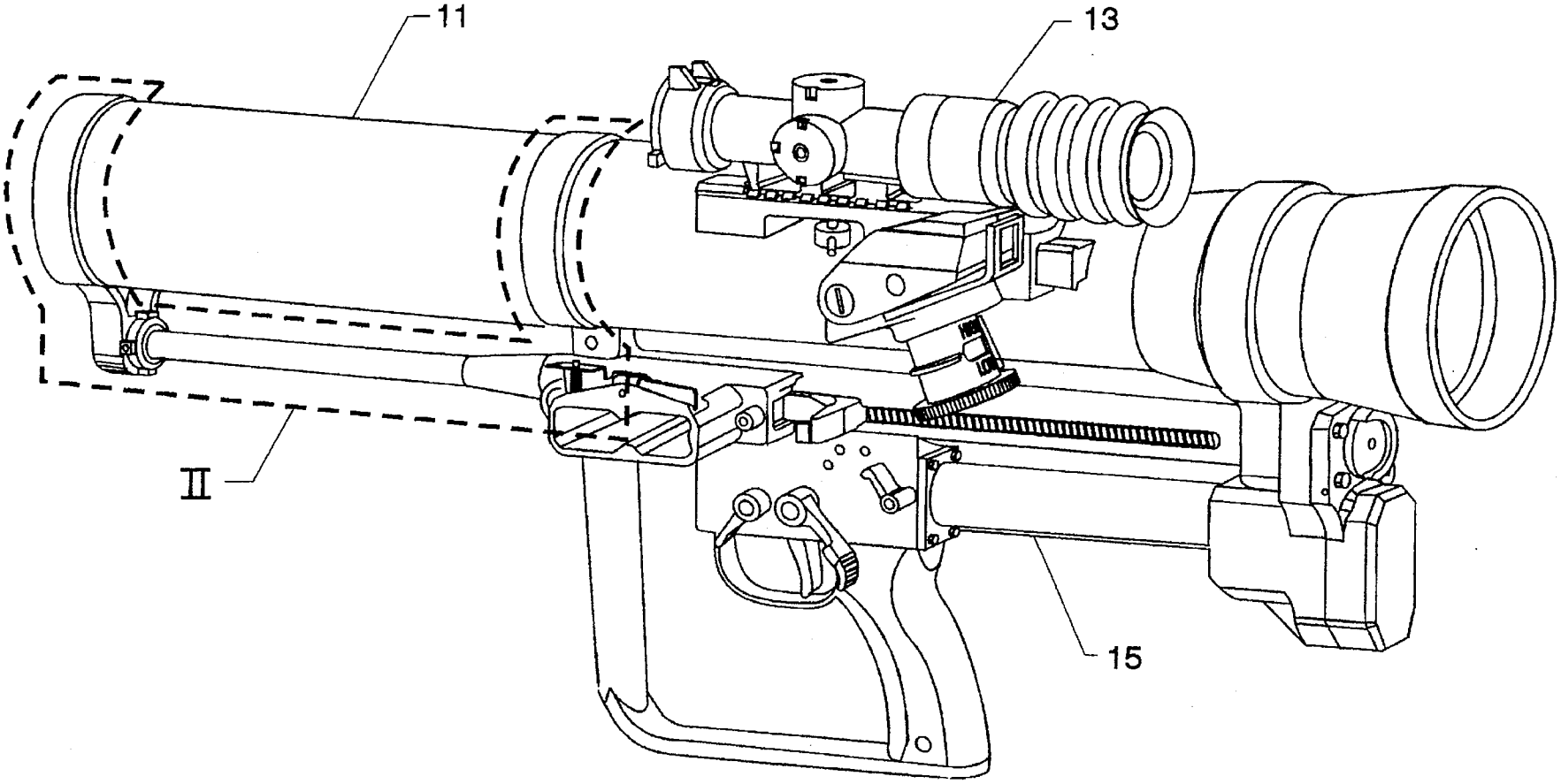
FIG. 1 is a perspective view of a rocket launcher showing the spotting rifle barrel alignment mechanism.

Referring now to the drawings and in particular to FIG. 1, the spotting round bore alignment mechanism of the present invention is shown attached to a rocket launcher. The rocket launcher tube 11 serves as a mount for the spotting rifle 15 and the sight unit 13. The present invention is shown in the dotted area II. The details of the spotting round bore alignment mechanism as shown in dotted area II, may be seen in more detail in FIG. 2.

Figure 2:
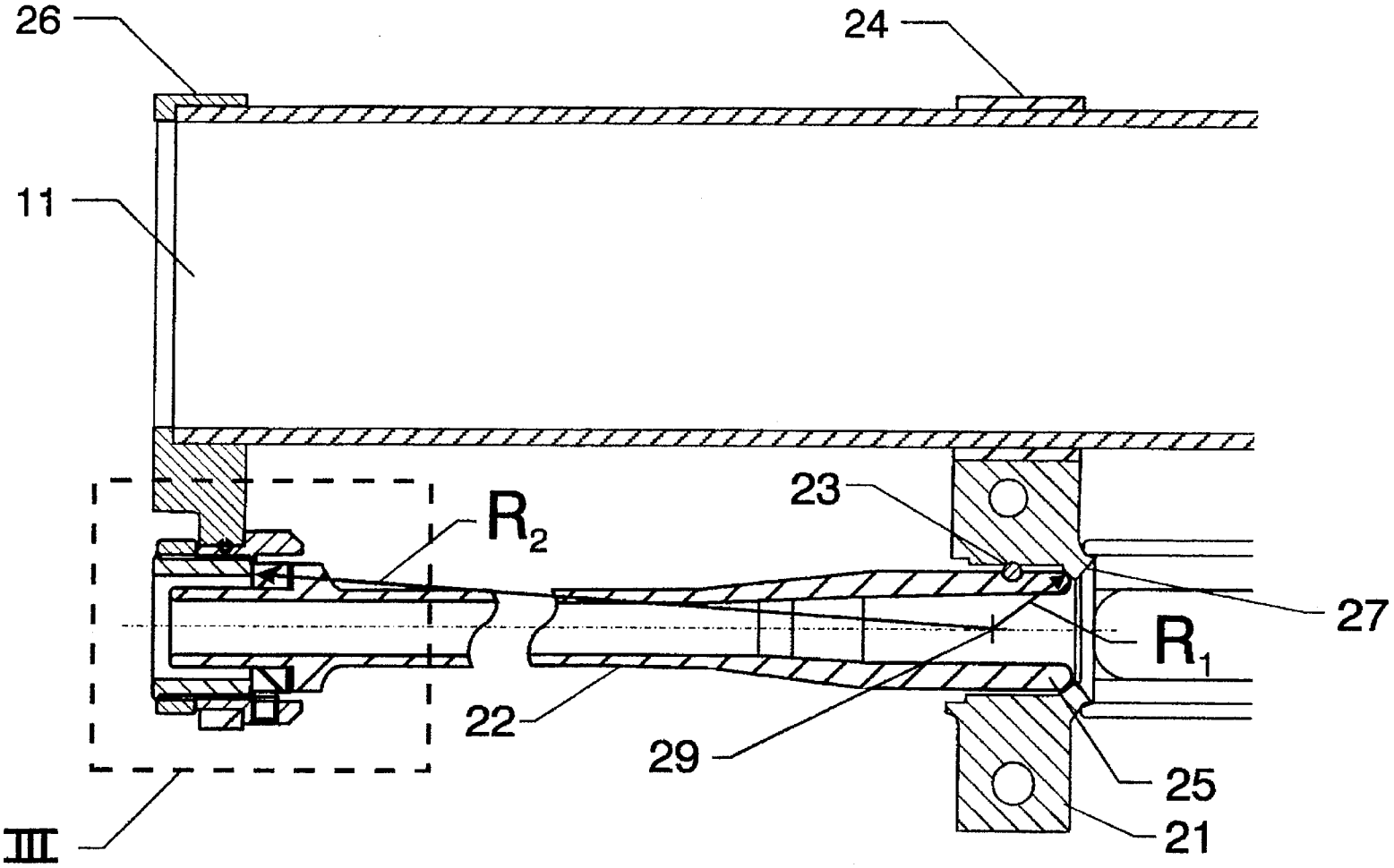
FIG. 2 is a partial cross-sectional view showing the spotting rifle barrel alignment components.

Referring now to FIG. 2, the muzzle end of the rocket launcher tube 11 is shown for reference with the spotter rifle barrel 22 attached beneath the rocket launcher tube. The barrel 22 has a retaining pin 23 to hold it attached to the receiver block 21. The invention uses a convex spherical or near spherical convex surface on the rear of the barrel 25 which is mated to a concave conical surface on the receiver 27. The receiver block 21 is rigidly affixed to the main launching tube 11 by receiver ring bracket assembly 24. At the muzzle end, supports for the spotting rifle barrel are attached using the muzzle ring bracket assembly 26. The radius $R_1$ of the breech shoulders of the barrel 22 is located at point 29. This location (point 29) of the radius center is approximately a distance of one external barrel radius forward of the breech end of the spotter barrel. This radius location 29 allows a pivoting of the barrel in a small arc to adjust the rear interface of the barrel with the receiver. Adjustment of the angle of the barrel is accomplished by adjustment of the screws in dotted section III. These details are shown more fully in FIG. 3.

Figure 3:
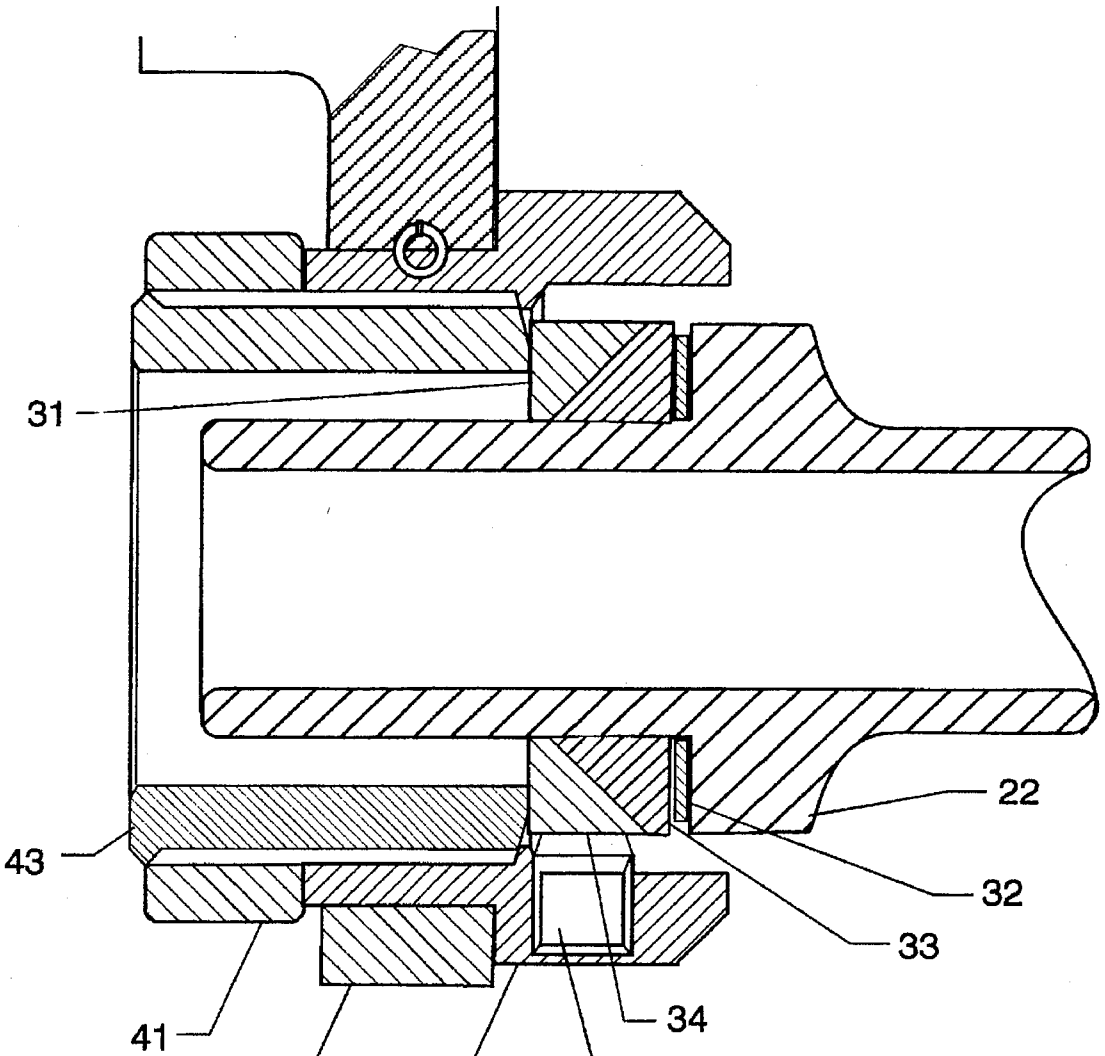
FIG. 3 is a partial cross-sectional view showing the nuzzle end of the spotting rifle barrel.

Referring now to FIG. 3, barrel 22 is shown for reference. Immediately ahead of the muzzle shoulders of the barrel section 22 is a circular spring and washer assembly. This includes a compression spring 32 which allows slight forward movement of the barrel. Immediately ahead of the compression spring 32 is a grip collar 33. Grip collar 33 is a split ring design allowing expansion of the collar depending on temperature of the barrel and also allowing a clamping effect as the grip collar is forced towards adjacent locating washer 34. The locating washer 34 is adjusted by three adjustment screws 39 (only one of which is shown here for clarity), each of the screws being located 120° around the barrel. The barrel locating bushing 35 is fixed around the muzzle end of the barrel and is itself encircled by bracket 37 which attaches to the main launcher tube not shown in this figure. A jam nut 41 secures the assembly to the barrel. A barrel collar 43 acts as a support for the locating washer with respect to forward movement. Barrel collar 43 seats against locating washer 34 with a rounded surface. The locating washer 34 itself also has a spherical surface as shown by surface 31 wherein the radius $R_2$ of the forward side of the locating washer is drawn from center 29 shown in FIG. 2. As a result of these radii being located around a common center 29, the barrel can be rotated slightly while maintaining snug contact with the fixed receiver breech surface.

OPERATION OF THE INVENTION

The common radii centers of grip collar 33 and of the breech shoulders 25 (around center 29) allow the barrel to be adjusted up and down and laterally to make an exact parallel match to launcher tube barrel 11. As surfaces at the muzzle end and rear end of the barrel are radiused off the common center, there is no gap, extension, or spaces developed due to pivoting of the barrel. Additionally, conical surfaces shown on grip collar 33 and the matching conical surface on locating washer 34 allow an expansion of the barrel due to heat. As a result of these features, the spotting rifle barrel can be aligned to provide an exact parallel axis with the main longitudinal axis of the launcher tube and will remain in that position even after repeated firings and after heating of the barrel. As the barrel expands, compression of spring 32 takes care of linear expansion of the barrel and the expansion of the split grip collar compensates for cross-sectional expansion of the barrel.

The features and advantages of the present invention are numerous. The spotting round barrel axis can be quickly and easily aligned with the launcher tube and can achieve a high level of precision in the alignment. Neither a firing of the spotting rifle or the rocket tube, nor a changing in heat or temperature of any part alter the alignment. Any longitudinal expansion is compensated for by compression of the spring retainer in the conical gripping collar. The split conical gripping collar compensates for any cross-sectional expansion of the barrel. All of these movements or expansions can take place while maintaining a precise alignment. Additionally, the common radiused surfaces on either end of the barrel allow the barrel to be rotated through a small arc necessary to make the adjustments while maintaining a perfect mate with the receiver.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by letters patent of the United States is:

1. A spotting round bore alignment mechanism for a rocket launcher comprising:

means for attaching a spotting round rifle barrel to a rocket launcher tube;

a fixed receiver for a spotting rifle attached to said means for attaching;

a spotting rifle barrel having a muzzle end and a breech end, said breech end having a spherical mating surface for mating with said fixed receiver; and a means for supporting the muzzle end of said spotting rifle barrel.

2. A spotting round bore alignment mechanism as in claim 1 wherein said means for attaching comprises a receiver bracket having a clamp ring for attachment to a rocket launcher tube.

3. A spotting round bore alignment mechanism as in claim 1 wherein said fixed receiver has a concave conical surface for mating to said spotting rifle barrel.

4. A spotting round bore alignment mechanism as in claim 1 wherein said rifle barrel has a spherical mating surface having a radius center located at longitudinal distance from the breech end of the barrel approximately equal to the outside radius of the spotter barrel.

5. A spotting round bore alignment mechanism as in claim 1 wherein said means for supporting the muzzle end of the spotting rifle barrel comprises a bracket assembly attached to the rocket launch tube.

6. A spotting round bore alignment mechanism as in claim 5 wherein said means for supporting further comprises a barrel locating bushing, barrel collar, and jam nut attached to said bracket assembly.

7. A spotting round bore alignment mechanism as in claim 6 wherein said means for supporting includes a plurality of adjustment screws threaded through and located around the circumference of said locating bushing.

8. A spotting round bore alignment mechanism as in claim 7 wherein said supporting means includes a locating washer, collar and spring assembly fitted around the spotting rifle barrel.

9. A spotting round bore alignment mechanism as in claim 8 wherein said locating washer has a muzzle end surface for mating to said barrel collar.

10. A spotting round bore alignment mechanism as in claim 9 wherein said locating washer has a muzzle end surface having a spherical shape.

11. A spotting round bore alignment mechanism as in claim 10 wherein said locating washer has a spherical surface having a radius center located at the center and near the breech end of said spotting rifle barrel approximately one outside barrel radius from the breech end.

12. A spotting round bore alignment mechanism for a rocket launcher comprising:

a receiver ring bracket assembly for attaching a spotting rifle receiver to a rocket launcher tube, said receiver having a concave conical surface for mating with a spotting rifle barrel;

a spotting rifle barrel mated to said receiver having spherical breech shoulders and muzzle end retaining shoulders;

a barrel retaining pin attached to said receiver and ring bracket and further securing said spotting rifle barrel to said receiver;

a muzzle ring bracket assembly for attaching the muzzle of the spotter rifle barrel supports to a rocket launcher tube;

a locating washer, grip collar and spring assembly mating said spotter rifle muzzle shoulders and engaging said locating washer having a spherical surface for engagement of said muzzle ring bracket assembly; and adjustment screws threaded through said muzzle bracket assembly and providing an adjustment to align the spotter rifle barrel axis with the rocket launcher tube.

* * * * *